US005819964A

United States Patent [19]

Grimard

[11] Patent Number: 5,819,964

[45] Date of Patent: Oct. 13, 1998

[54] LYOPHILIZATION CLOSURE ASSEMBLY FOR A MEDICAMENT CONTAINER FOR USE DURING A LYOPHILIZATION PROCESS

[75] Inventor: Jean Pierre Grimard, Vif, France

[73] Assignee: Becton Dickinson and Company, Franklin Lakes, N.J.

[21] Appl. No.: 825,836

[22] Filed: Apr. 4, 1997

Related U.S. Application Data

[63] Continuation of Ser. No. 722,289, Sep. 27, 1996, abandoned.

[51] Int. Cl.[6] ..... B65D 41/58

[52] U.S. Cl. ..... 215/249; 215/251; 215/263; 215/274; 215/307; 215/355

[58] Field of Search ..... 215/247, 249, 215/251, 258, 263, 272, 274, 307, 309, 321, 355, 364, DIG. 3; 220/254, 257

[56] References Cited

U.S. PATENT DOCUMENTS

| | | | |
|---|---|---|---|
| 3,379,326 | 4/1968 | Andersen | 215/249 |
| 3,792,794 | 2/1974 | Cutter et al. | 215/247 |
| 4,089,432 | 5/1978 | Crankshaw et al. | 215/249 X |
| 4,211,333 | 7/1980 | Villarejos | 215/249 |
| 4,301,936 | 11/1981 | Percarpio | 215/247 |
| 4,657,152 | 4/1987 | Carveth et al. | 215/249 |
| 4,739,891 | 4/1988 | Bullock, III | 215/232 |
| 5,016,770 | 5/1991 | Rizzardi | 215/232 |
| 5,085,332 | 2/1992 | Gettig et al. | 215/249 |
| 5,114,030 | 5/1992 | Conard | 215/249 |
| 5,314,084 | 5/1994 | Folta et al. | 215/249 |
| 5,358,501 | 10/1994 | Meyer | 604/414 |

FOREIGN PATENT DOCUMENTS

| | | |
|---|---|---|
| 0 006 032 | 12/1979 | European Pat. Off. . |
| 2 036 746 | 12/1970 | France . |
| 2 529 531 | 6/1984 | France . |
| WO 94/04424 | 3/1994 | WIPO . |

OTHER PUBLICATIONS 6 pages from PHARMA–METALL brochure Mar. 2, 1994 "General Presentation of Pharma Metall Products".

"Verschlusse fur die pharmazeutische Industrie" (Closures for the Pharmaceutical Industry) Pharma–Metall Dec. 7, 1994.

2 pages of drawings and table (ISO 8362–2: 1988 (F) "Not Titled".

*Primary Examiner*—Stephen Cronin
*Attorney, Agent, or Firm*—Allen W. Wark

[57] ABSTRACT

A lyophilization closure assembly for a container or vial is disclosed. The lyophilization closure assembly is self-supporting with the container and may be employed with the container during a lyophilization process, eliminating the need for a separate crimping operation outside of the sterile environment in which lyophilization is conducted. The lyophilization closure assembly includes a body with a skirt disposed around the rim of the container. The skirt features one or more deflectable abutments and one or more deflectable latches positionable about the rim of the container, and defines one or more vapor passages. An elastomeric closure is retained within the body for sealing the open top of the medicament container. The elastomeric closure features a plug for sealing the open top of the container and a top surface facing away from the open top of the container. The body defines an opening over the elastomeric closure that delimits an access area on the top surface of the closure. A membrane is removably secured over the access area of the elastomeric closure and hermetically encloses the access area.

22 Claims, 11 Drawing Sheets

LYOPHILIZATION CLOSURE ASSEMBLY FOR A MEDICAMENT CONTAINER FOR USE DURING A LYOPHILIZATION PROCESS

This application is a continuation of application Ser. No. 08/722,289, filed Sept. 27, 1996 now abandoned.

I. FIELD OF THE INVENTION

The invention relates to a lyophilization closure assembly for a medicament container, and more particularly, to a lyophilization closure assembly for a medicament container which is self supporting with the container and which can be easily sealed to the container within the sterile environment of the lyophilization chamber.

II. BACKGROUND

In order to enhance the shelf life of certain drugs, a pharmaceutical manufacturer may subject the drug to a lyophilization process. In the lyophilization process, a liquid drug contained in a container or vial is subjected to a freeze drying process to extract the aqueous content from the drug, leaving the active components of the drug in a crystalline state.

FIG. 11 illustrates a prior art manner for effecting a lyophilization process. A container 600 includes a rim 614 and features a quantity of medicament 616 to be lyophilized. Before the container is introduced into the freeze dryer, a lyophilization stopper 620 having a plug 626 is partially inserted into the neck 618 of the container. Plug 626 includes a groove 622 which, when the plug is partially inserted into the neck, communicates the interior of the container with the freeze dryer, allowing vapors generated during the lyophilization process to escape from the container. After the lyophilization operation, shelves provided within the freeze dryer are typically lowered against flange 624, such that plug 626 is fully inserted into neck 618 so as to seal the drug within the container.

After the stoppering operation, the lyophilization stopper has to be secured to the container. Typically, in order to do this, the container is removed from the sterile environment of the freeze dryer, and an aluminum crimp cap applied about flange 624 and rim 614 to fix the lyophilization closure to the container. The crimp cap typically incorporates a removable pad located over a central area of the lyophilization stopper. The removable pad allows a user to access the central area and, to an extent, can serve as tamper evidence means for the container. The removable pad also serves, to a certain extent, as a means to preserve the cleanliness of the top surface of the lyophilization stopper.

In practice, the lyophilized drug is accessed shortly prior to use by removing the pad from the crimp cap so as to access the lyophilization closure. The closure is pierced, and a solvent solution such as saline introduced into the vial to reconstitute the powdered or lyophilized drug. Once reconstituted, the drug solution is extracted from the vial for use.

While in general these assemblies work well to safely store the drug prior to use, there are certain drawbacks which merit address. The removable pads associated with the aluminum crimp caps have sharp edges, which can pierce the safety gloves employed by practitioners if proper care is not practiced. Moreover, most crimp caps employed with the prior art vials are not constructed, nor are they processed, in a manner to maintain the sterility of the top surface of the closure. As a result, the central area of the prior art lyophilization closure must be sterilized, for instance, with an alcohol solution, before the closure is pierced.

Additional drawbacks exist at the pharmaceutical manufacturer level. Lyophilization is typically conducted in the sterile environment of the freeze dryer. It is sometimes the case that the grooves provided on the lyophilization closure offer a restricted passage to the vapors generated. Because of the groove, the molds are more complicated than with more standard designs. Also, the plug of the lyophilization closure is longer than it could be without the groove, meaning that more rubber material is needed.

As has been explained, in order to fasten the closure to the vial, additional equipment, such as equipment for applying the crimp cap to the vial rim, is necessary. The crimping operation is normally performed separately of the lyophilization operation and outside of the sterile environment of the lyophilization area. This adds time and expense to the manufacturing operation. Furthermore, because the top surface of the lyophilization closure is exposed to a non-sterile environment during the crimping operation, an end user must sterilize the top surface of the lyophilization closure such as with an alcohol solution before the drug can be accessed.

III. SUMMARY OF THE INVENTION

A lyophilization closure assembly for a medicament container, such as a bottle or vial, is disclosed. The lyophilization closure assembly, which is self supporting on the container, can be affixed to the container while the medicament is subjected to a lyophilization process to provide free, unobstructed passage of vapors generated during the lyophilization process. The lyophilization closure assembly can thereafter be sealed against the container and fixed to it while in the sterile environment of the lyophilization chamber. The lyophilization closure assembly thus permits the lyophilization operation and subsequent complete stoppering operation to occur in one step, eliminating the need for an additional procedure outside of the sterile environment in which the lyophilization operation takes place.

The lyophilization closure assembly includes a body supported about the rim of the container. The body includes a distal wall facing the open top of the container and a skirt which is positioned around the rim. The skirt includes one or more deflectable arms engageable with the rim and one or more vapor passages through which vapors generated during a lyophilization process can escape. The body is positionable about the rim between a first position, wherein the drug in the container is subjected to a lyophilization procedure, and a second position, wherein the lyophilization closure assembly is sealed to the container.

An elastomeric closure for sealing the open top of the container is retained within the body. The elastomeric closure features a plug for sealing the open top of the container, and a top surface facing away from the open top of the container. The distal wall of the body defines an opening over the top surface of the elastomeric closure that delimits an access area. A membrane is removably secured to the body over the access area on the top surface of the elastomeric closure. The membrane includes a pull-tab which permits the practitioner to remove the membrane from the body when access to the drug is desired.

In use, the lyophilization closure assembly is secured to the container in a first position, wherein the elastomeric closure is spaced from the open top of the container. Vapors generated during the lyophilization process may escape from the container via the vapor passages provided on the body. Subsequent to the lyophilization operation, and while the container remains in the lyophilization chamber, the lyophilization closure assembly may be urged to the second position, wherein the body is locked to the rim of the container and the elastomeric closure is positioned to seal the open top of the container. Accordingly, the lyophilization and complete stoppering operations may occur in a single process within the sterile environment of the lyophilization chamber, obviating the need for an additional stoppering operation outside of the sterile environment in which lyophilization takes place.

The elastomeric closure can be formed of various rubber materials, the body can be formed of various rigid materials such as plastics materials, and the membrane can be formed of various plastic materials, composite materials, paper materials, metallic foil materials, TYVEK materials, or the like. The various components can be separately supplied to a pharmaceutical manufacturer in a sterile state, with the pharmaceutical manufacturer assembling the components into lyophilization closure assembly. Alternately, the lyophilization closure assembly can be supplied to a pharmaceutical manufacturer in a pre-assembled sterile state, with the pharmaceutical manufacturer applying the pre-assembled, sterile assembly to the medicament container. The sterile membrane hermetically encloses the access area of the elastomeric closure, eliminating the need to sterilize the top surface, such as with an alcohol solution, prior to use of the drug. Also, the sterile membrane provides tamper evidence for the contents held within the container.

If desired, a washer may be incorporated on the top surface of the elastomeric closure. The washer includes an opening disposed over the top surface of the closure which defines the access area on the top surface of the elastomeric closure. The membrane may be removably secured to the washer, and if desired, extended to a portion of the body.

IV. BRIEF DESCRIPTION OF THE DRAWINGS

The invention will now be described in greater detail by way of reference to the appended drawings, wherein.

Figure 2:
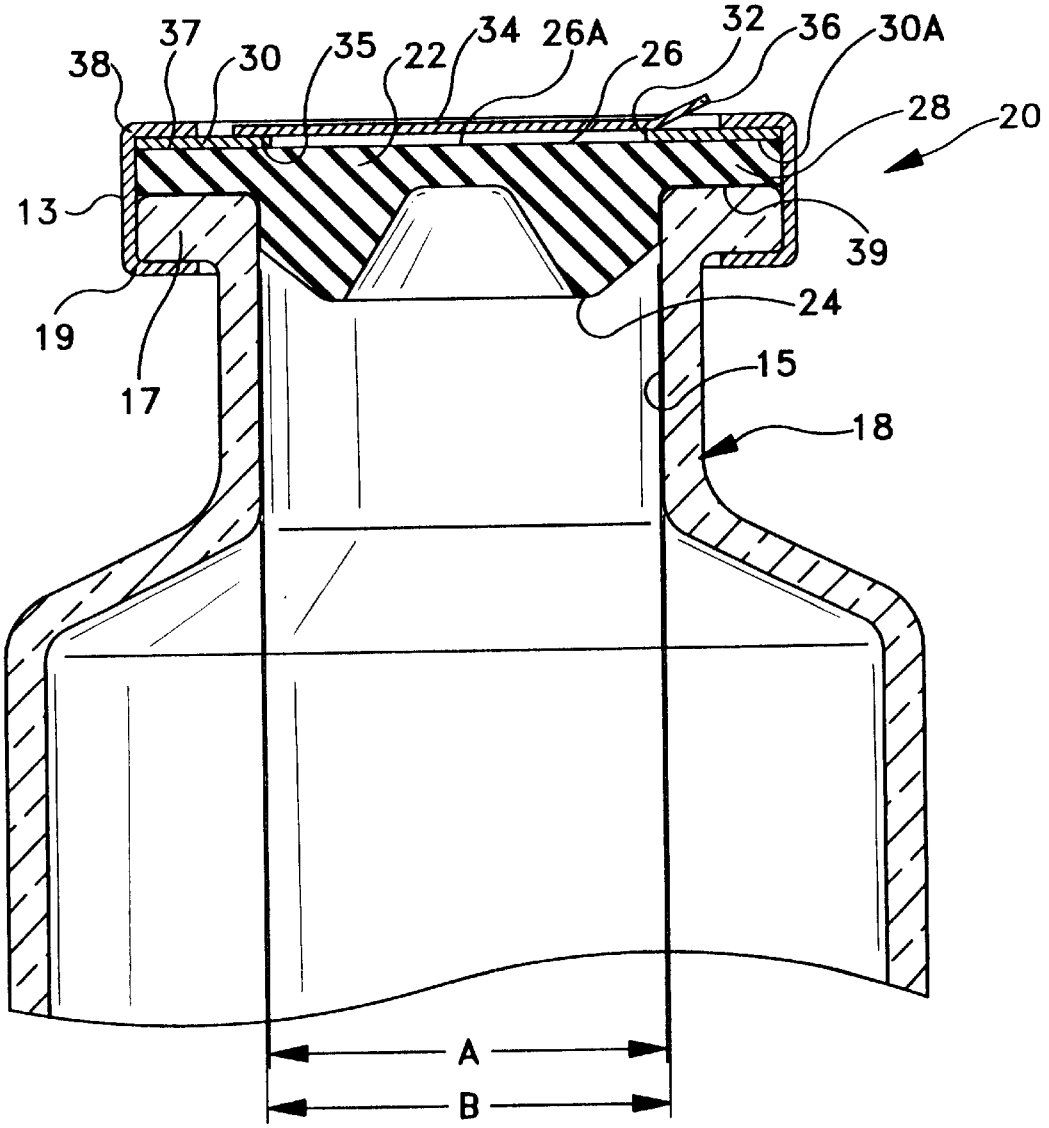
FIG. 2 is a cross-sectional view of one embodiment of a sterile closure in accordance with the present invention.
Figure 2A:
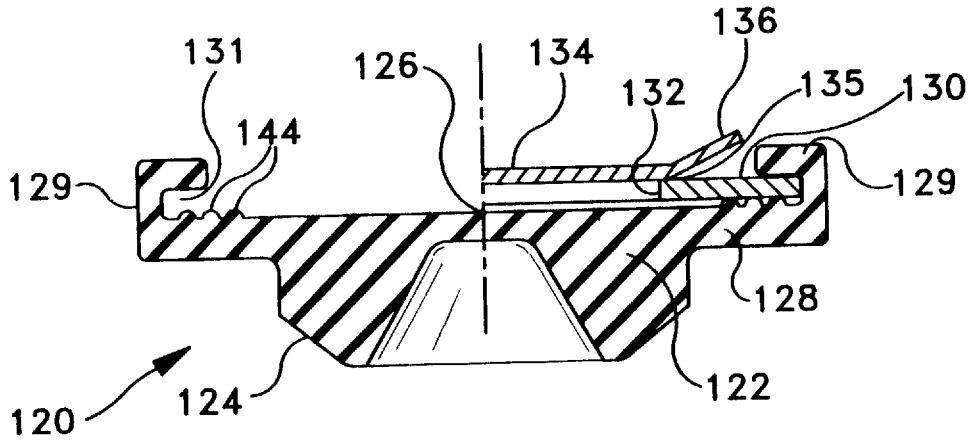
Figure 2B:
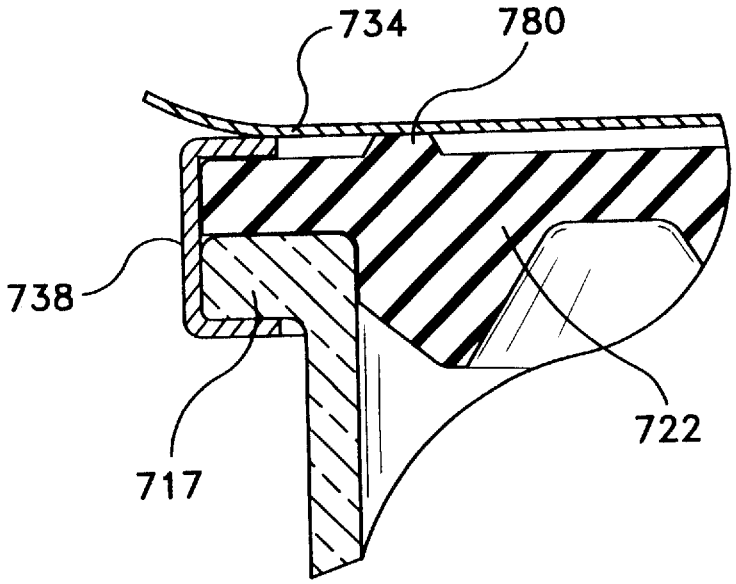
Figure 3:
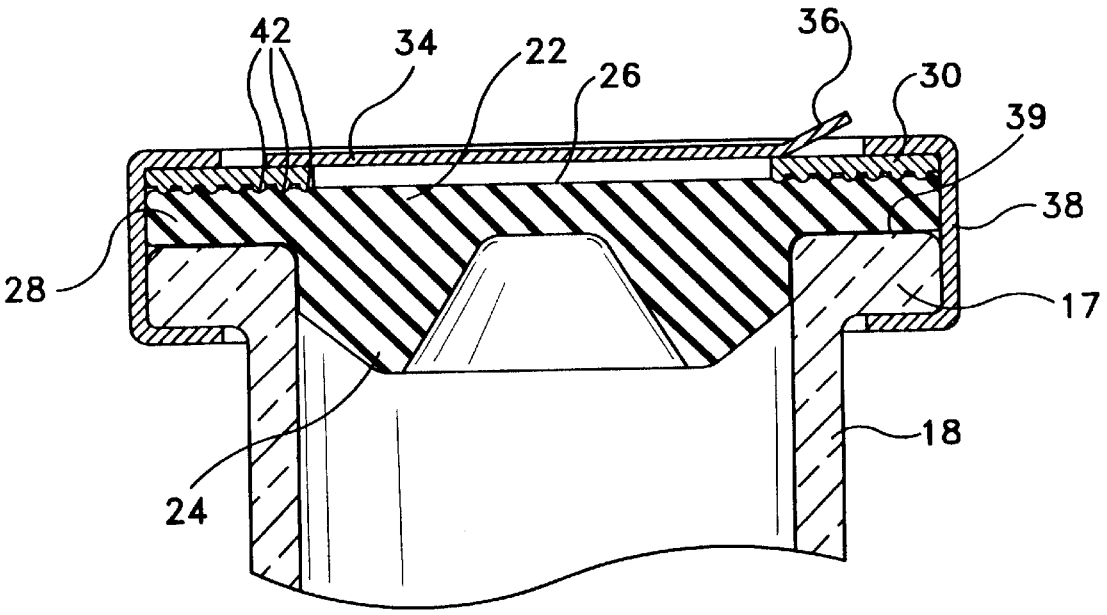
Figure 4:
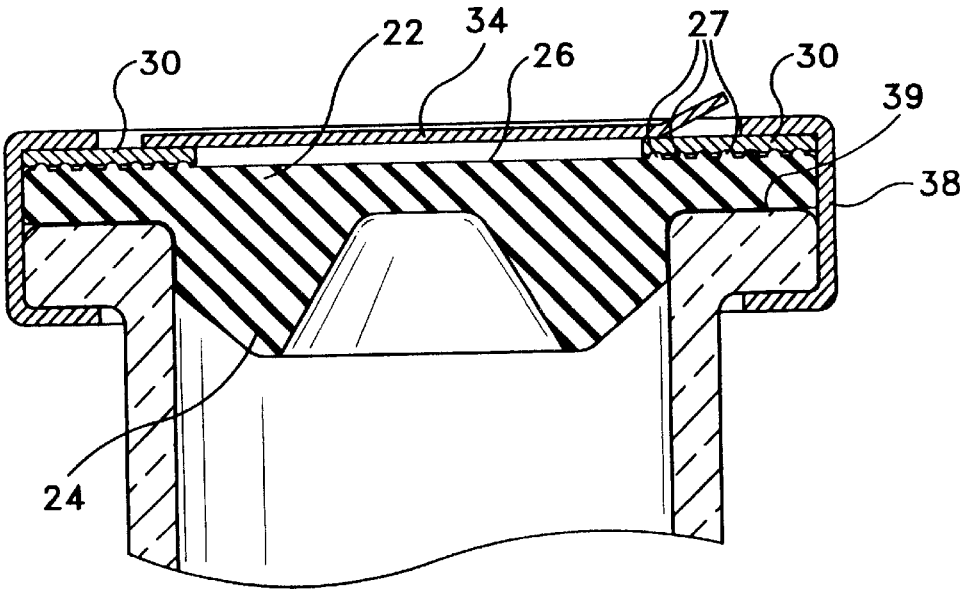
Figure 5:
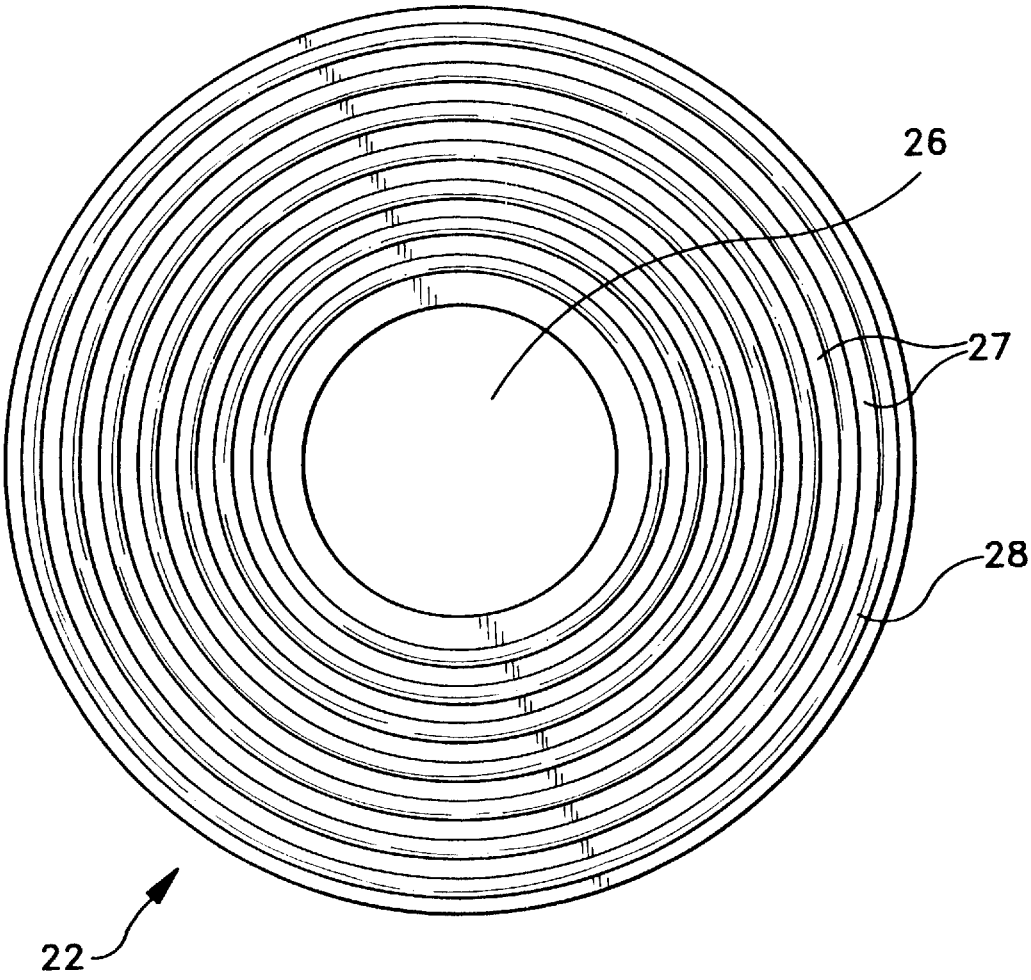
Figure 6:
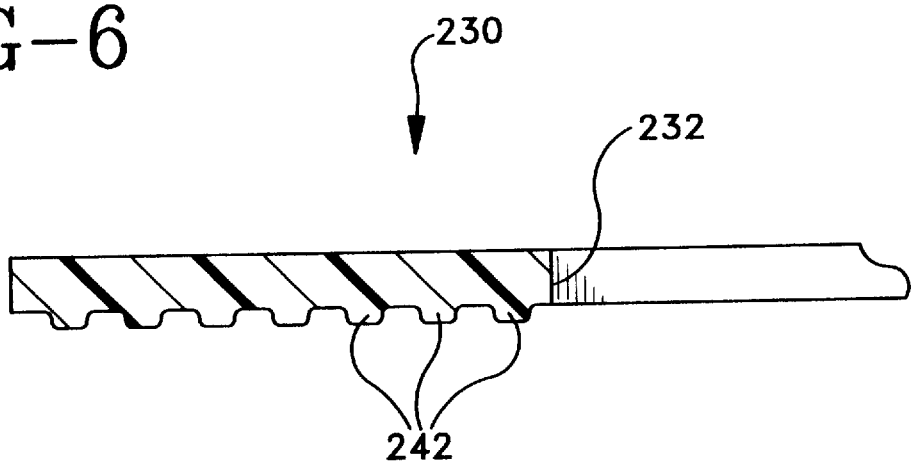
Figure 7:
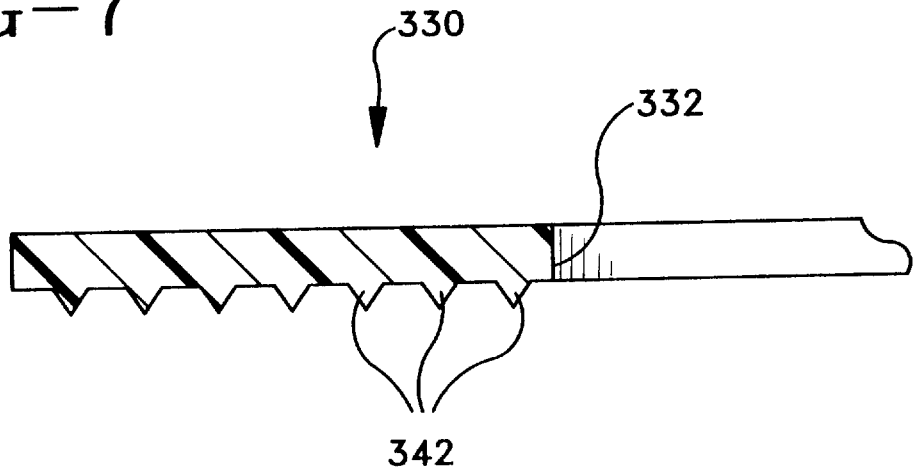
Figure 8:
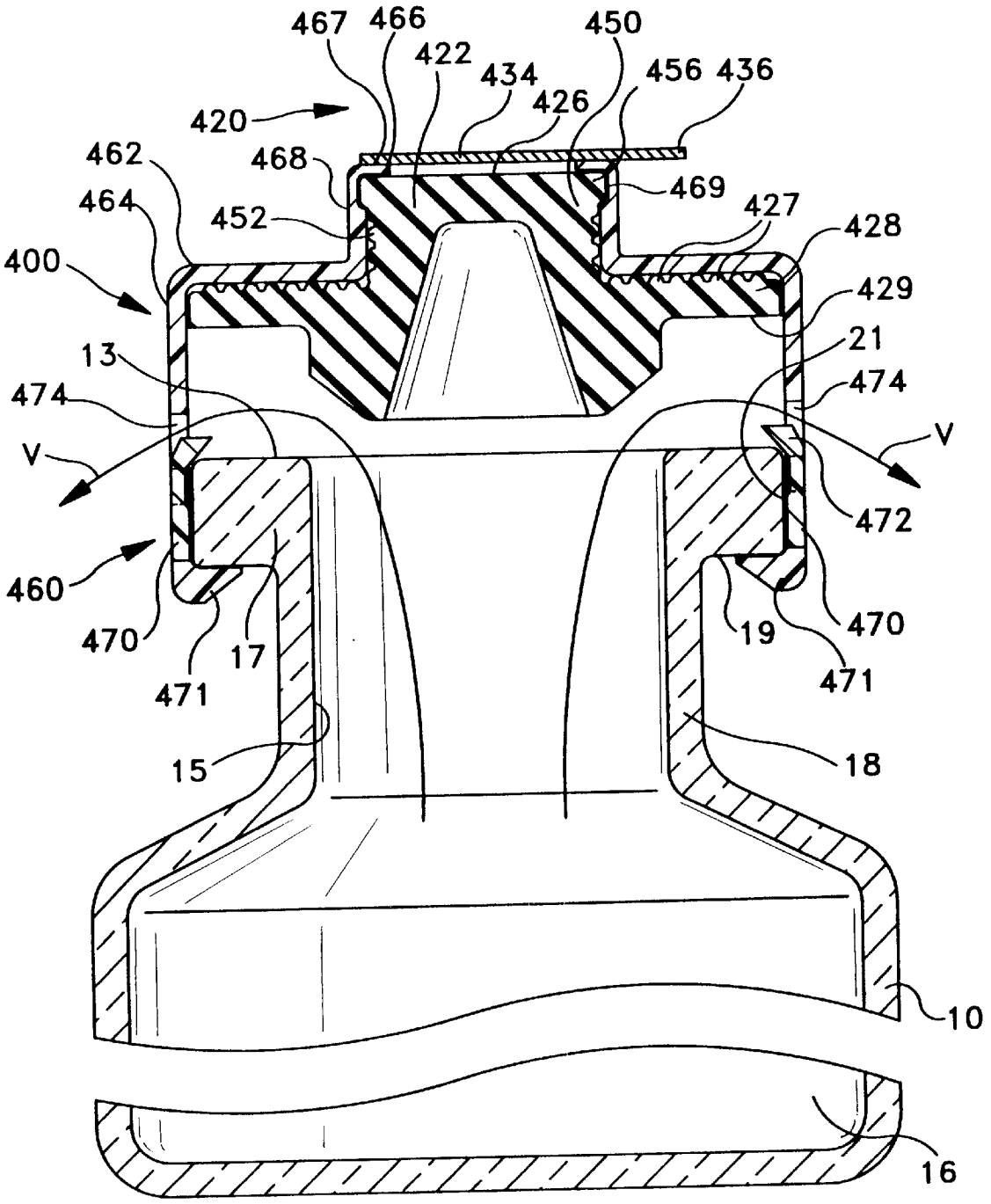
Figure 8A:
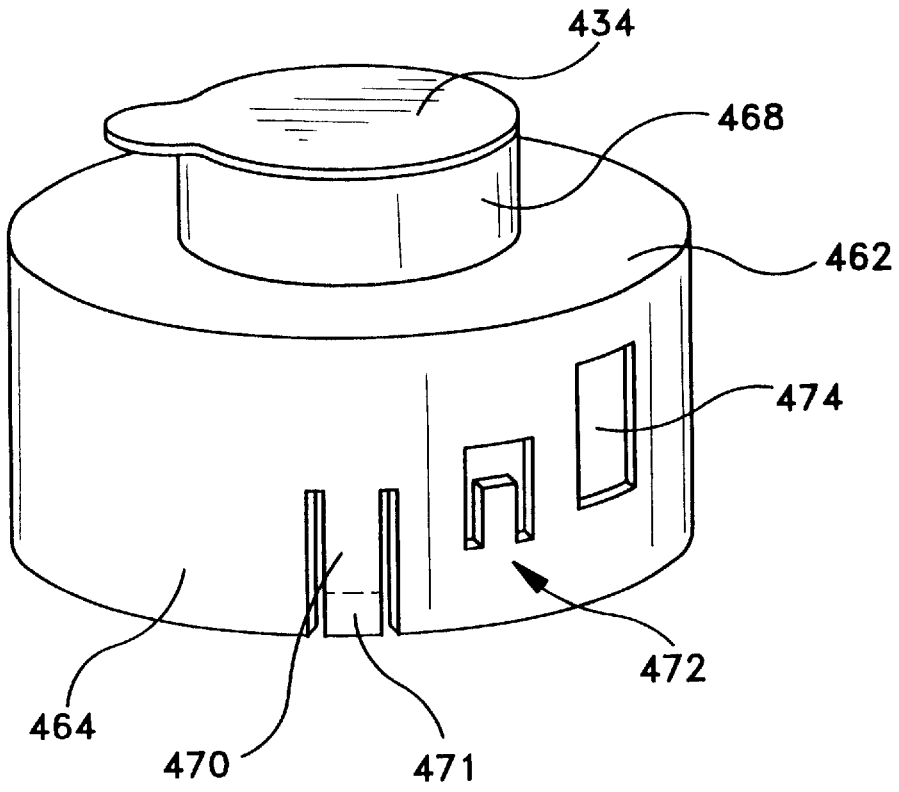
Figure 9:
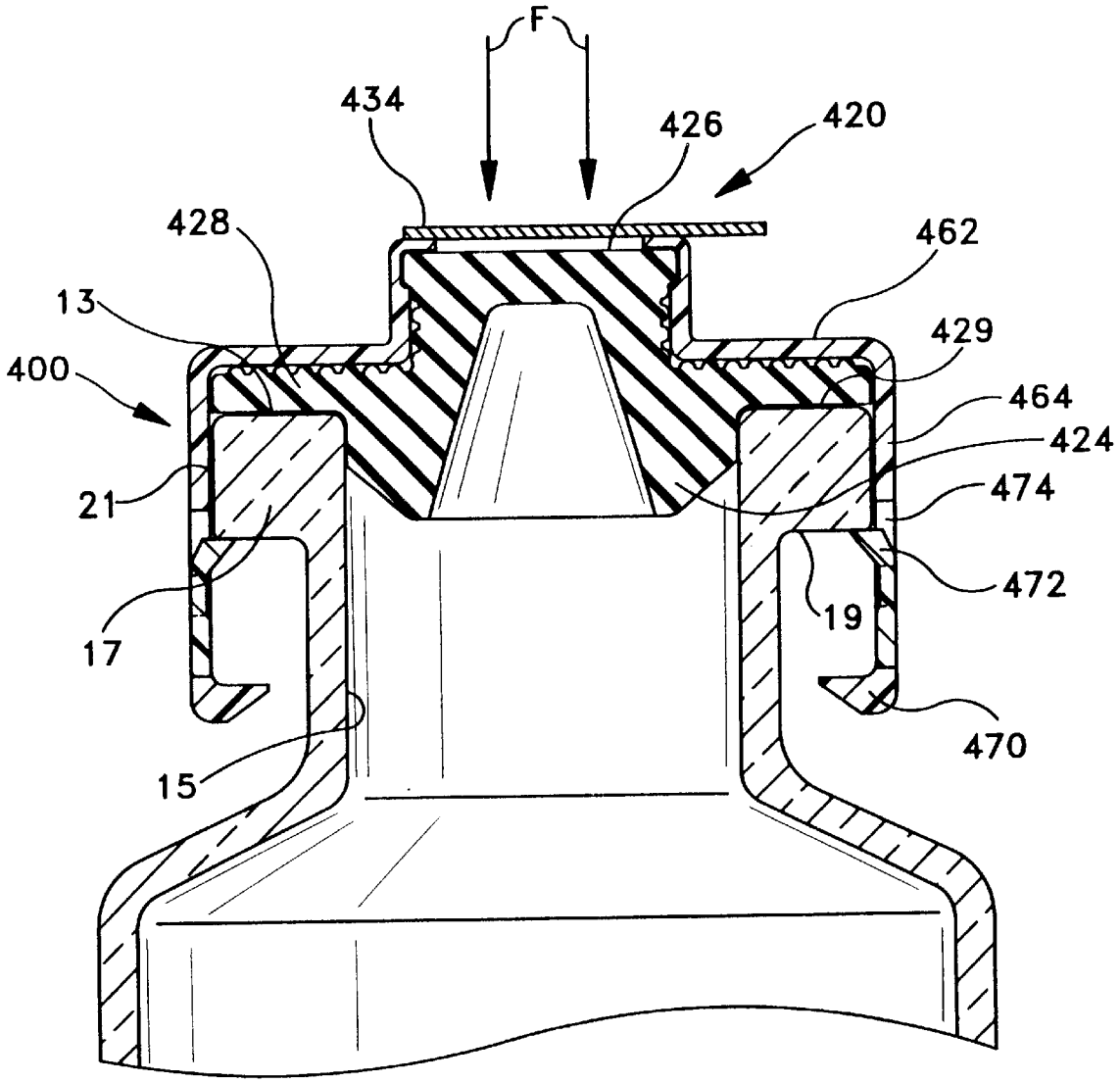
Figure 10:
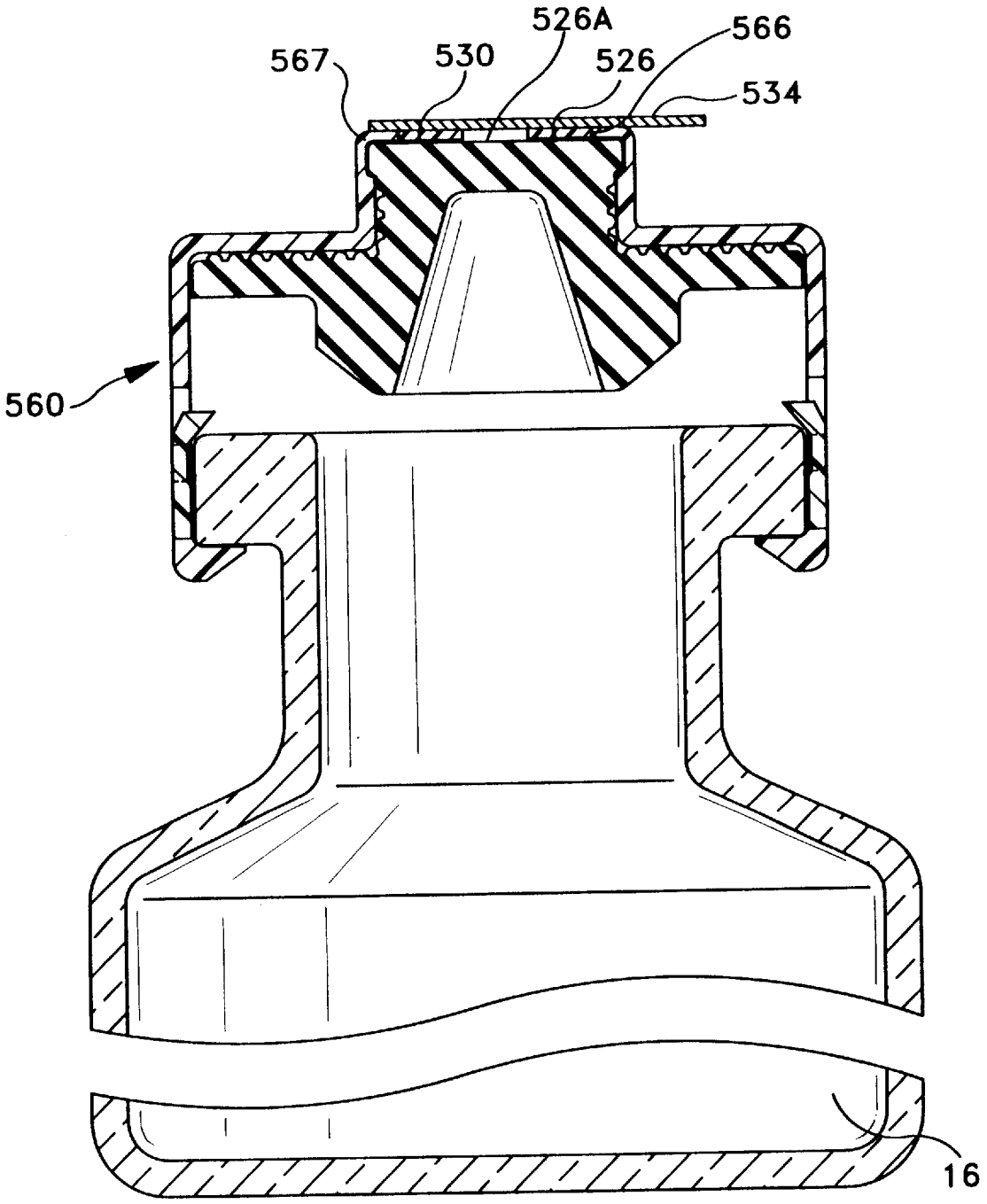
Figure 11:
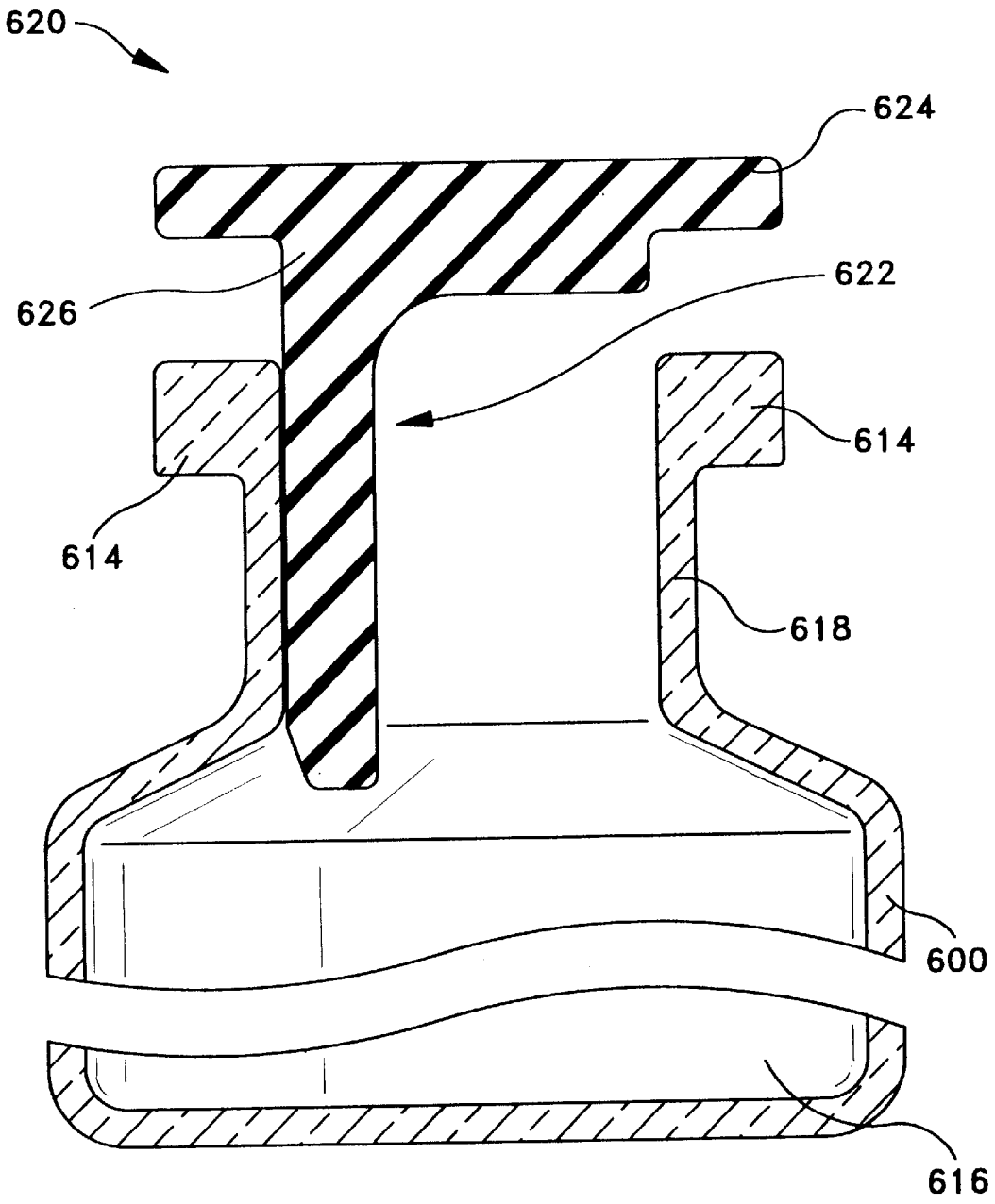
FIG-11 PRIOR ART

FIG. 2*a* depicts an alternate way to configure a sterile closure in accordance with the present invention;

FIG. 2*b* depicts an alternate way to configure a sterile closure in accordance with the present invention;

FIG. 3 is a cross-sectional view of an embodiment of a sterile closure in accordance with the present invention incorporating sterility-enhancing ribs;

FIG. 4 is an alternate embodiment of the sterile closure depicted in FIG. 3;

FIG. 5 is a top view of an elastomeric closure utilizable with a sterile closure in accordance with the present invention;

FIG. 6 depicts a cross-sectional view of a washer for a sterile closure in accordance with the present invention;

FIG. 7 depicts an alternate embodiment of a washer for a sterile closure in accordance with the present invention;

FIG. 8 is a cross-sectional view of a lyophilization closure assembly for a medical container in accordance with the present invention;

FIG. 8*a* depicts a transfer body utilizable with the lyophilization closure assembly of FIG. 8;

FIG. 9 depicts the lyophilization closure assembly of FIG. 8 subsequent to a lyophilization procedure;

FIG. 10 depicts an alternate embodiment of a lyophilization closure assembly in accordance with the present invention; and FIG. 11 depicts a prior art manner for effecting a lyophilization process.

V. DETAILED DESCRIPTION OF THE PREFERRED EMBODIMENTS

While the description and figures herein makes reference to a vial or bottle, it will be understood and appreciated by the skilled artisan that any type of container normally employed in the field of endeavor, such as capsules, jars or like vessels are readily amenable to the advantages described herein. In addition, while herein described with regard to containers having a quantity of dry drug or medicament for reconstitution by liquid obtained from an external source, it will be appreciated by the skilled artisan that the invention is not so limited. For instance, the invention may be applied to containers holding therein a quantity of liquid medication.

For purposes of simplicity, a sterile closure assembly in accordance with the present invention will first be described, followed by a description of how the features of the sterile closure assembly in accordance with the present invention can be implemented into a lyophilization closure assembly.

Figure 1:
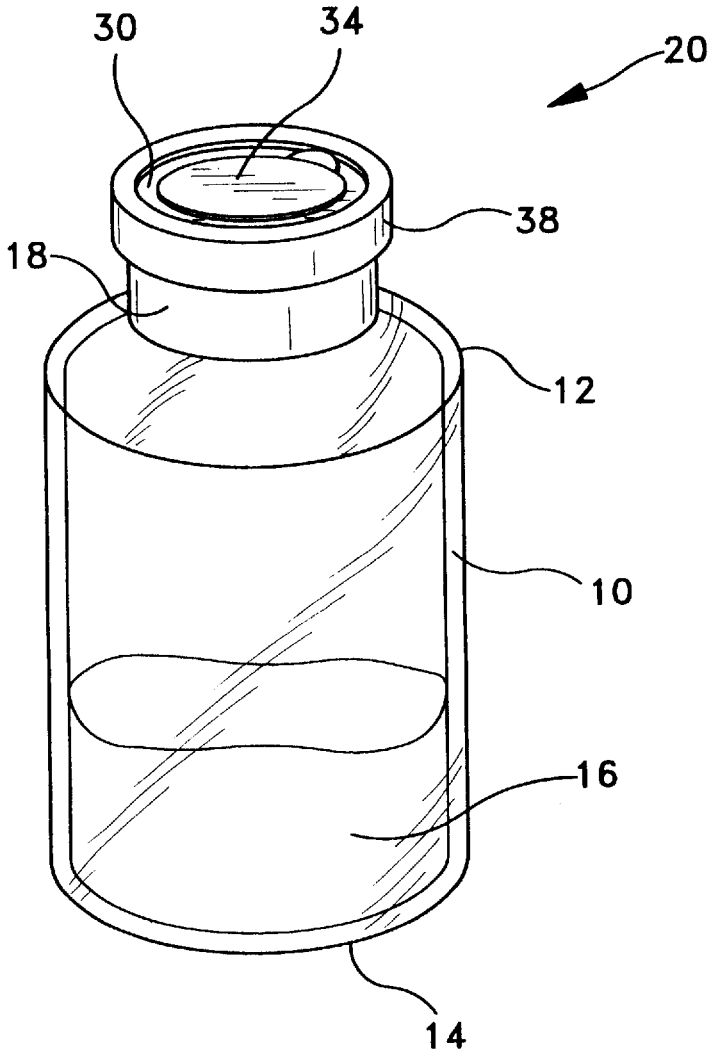
FIG. 1 is a perspective view of the sterile closure for a container or vial in accordance with the present invention.

Turning then to FIGS. 1 and 2, sterile closure assembly 20 in accordance with the present invention may be applied to a medicament container 10, such as a vial or bottle, having a distal end 12, a proximal end 14, and containing a charge of medicament 16 therein. As will be further hereinafter described, the charge of medicament 16 can entail, for instance, a charge of medicament subjected to a lyophilization procedure. Medicament container 10 includes a neck 18 characterized by an open top 15. Open top 15 is surrounded by a rim 17 having an upper surface 13 and a lower surface 19.

Sterile closure assembly 20 in accordance with the present invention includes an elastomeric closure 22 for sealing open top 15 of the medicament container. The elastomeric closure, which can be configured from a rubber material, includes a plug 24 preferably having a diameter "A" at least equal to, if not slightly greater than, diameter "B" of neck 18 so as to snugly close open top 15. Elastomeric closure 22 further includes a flange portion 28 configured to rest upon upper surface 13 of rim 17, and preferably, structured and otherwise arranged to substantially cover the entire area of upper surface 13 of the rim. A top surface 26 is provided on the elastomeric closure which faces away from the open top of the container. Top surface 26 includes an access area 26A intended to be accessed by a practitioner who desires to employ medicament 16 contained within container 10.

As previously explained, in the prior art closures, a practitioner was typically forced to sterilize top surface 26, such as with an alcohol solution, prior to use of the vial. The reason for this is that in the prior art, the aluminum crimp caps typically employed to retain the closures to the bottle were not constructed or otherwise process to maintain the sterility of the top surface of the closure. An advantage of sterile closure assembly 20 in accordance with the present invention is that it can be constructed such that the closure 20 is presented in a sterile, ready-to-use state at the end user level.

One way to insure the sterility of closure 20 is to eliminate a conventional aluminum crimp cap incorporating a removable pad, in favor of the construction disclosed herein. A washer 30 is configured to be disposed upon top surface 26 of elastomeric closure 22. Washer 30 includes a bottom surface 30A which makes contact with top surface 26 of the elastomeric closure along an interface 37. Preferably, interface 37 encompasses the entire area of bottom surface 30A. Washer 30 defines an opening 32 disposed over top surface 26 that delimits access area 26A provided upon top surface 26.

FIG. 2 illustrates a membrane 34 which is removably secured to washer 30 along an upper surface 35 of the washer. Membrane 34 protectively encloses access area 26A of top surface 26 in a sterile manner and is preferably affixed to the washer so as to hermetically seal access area 26A of the elastomeric closure. Membrane 34 preferably includes a pull-tab 36 to permit a user to detach membrane 34 from the washer when access to the elastomeric closure is desired.

The entire vial closure 20 can be secured to vial rim 17, for instance, by a crimp cap 38. Crimp cap 38 can be formed of any suitable rigid material, such as plastics, metals, or the like. As herein illustrated, crimp cap 38 engages top surface 35 of the washer and lower surface 19 of rim 17, thereby pressing washer 30 tightly against flange 28 of the elastomeric closure, and securing both to vial rim 17. In addition to sterility maintenance characteristics, the material selected for membrane 34 preferably avoids sharp edges so as to avoid the problems with conventional aluminum crimp caps, previously described. Also, it will be appreciated by the skilled artisan that in addition to ensuring the sterility of access area 26A, membrane 34 provides tamper evidence for the contents held within container 10.

It will be appreciated and understood by those skilled in the art that elastomeric closure 22, washer 30 and membrane 34 can be separately supplied to the pharmaceutical manufacturer in a sterile state, and assembled by the pharmaceutical manufacturer into vial closure assembly 20 during processing of the medicament container. Alternately, sterile closure assembly 20 can be supplied to the pharmaceutical manufacturer in a pre-assembled sterile state, permitting the pharmaceutical manufacturer to process vial closure assembly 20 as a single unit.

Elastomeric closure 22 can be formed from various rubber materials, while washer 30 can be formed from suitable rigid materials, including various plastic materials. Membrane 34 can be devised from any suitable material, such as plastics materials, composite materials, paper materials, metallic foil materials, TYVEK materials, or the like, which provide sterility maintenance of the elastomeric enclosure. Membrane 34 can be secured to washer 30 by adhesives, heat sealing, bonding, or other procedures suitable to the materials employed for the membrane and washer. It will be realized by the skilled artisan that elastomeric closure 22 and washer 30 can be formed together such as by a co-injection process. Similarly, washer 30 and membrane 34 can be formed together such as by a co-injection process, if desired. Alternately, all three components, the elastomeric closure, the washer and the membrane, can be formed together by an appropriate co-injection process, if desired.

It is preferable that washer 30 and elastomeric closure 22 be disposed in entire surface contact with one another so as to effect a good seal between these components. Particularly where washer 30 is supplied separately from elastomeric closure 22, structure may be incorporated at interface 37 to enhance sealing contact between washer 30 and top surface 26 to account for any molding irregularities, tolerance irregularities or the like. As seen in FIG. 3, one or more sealing ribs 42 can be formed on washer 30. Aided by the force of crimp cap 38, sealing ribs 42 will press into top surface 26 of the elastomeric closure to enhance sealing contact between them. Alternately, as seen in FIGS. 4 and 5, sealing ribs 27 may be provided on top surface 26 of the elastomeric closure, also to enhance sealing contact between the washer and the elastomeric closure.

It will also be appreciated that sealing ribs (not shown) can be incorporated at an interface 39 between the flange of the elastomeric closure and the rim of the container, and these sealing ribs provided either on the flange or on the rim, to enhance sealing contact between the two.

In the foregoing FIGS. 3–5, it will be seen that sealing ribs 27 and 42 are illustrated with rounded cross-sections. FIG. 6 illustrates an embodiment 230 of the washer, wherein the sealing ribs 242 are formed with a square cross-section. Alternately, as seen in FIG. 7, washer 330 can feature sealing ribs 342 formed with peaked cross sections. It will be apparent to the skilled artisan that any of these cross-sections may be applied to sealing ribs formed on top surface 26 of the elastomeric closure.

FIG. 2*a* illustrates a variant 120 of a sterile closure assembly in accordance with the present invention. Elastomeric closure 122 includes a plug 124 and a flange 128. Washer 130 is retained to elastomeric element 122 by a brace 129 defining a pocket 131 in which washer 130 is securely retained. One or more sealing ribs 144 can be provided on top surface 126 of elastomeric closure 122 to enhance sealing contact between washer 130 and top surface 126, as previously described. A membrane 134 is secured to washer 130 in a manner previously described. Here, vial closure 120 is retained to neck 17 of a medicament container (not shown) by securing a crimp cap (not shown) about brace 129 and the rim of the container.

While the foregoing sterile closure assemblies 20,120 have employed a washer 30,130 as part of their structure, it is also within the realm of the skilled artisan to forego a washer and to pre-affix a membrane 734 directly over a crimp cap 738. See FIG. 2*b*. Crimp cap 738 and membrane 734 can thereafter be placed over elastomeric closure 722 and rim 717 while the elastomeric closure and the rim are in a sterile environment. To assure that membrane 734 and crimp cap 738 are not disturbed or detached from the top of the container during handling operations between the sterile area and the crimping area, if desired, structure such as a rib 780 can be provided between membrane 734 and elastomeric closure 722. This provides a second area to which membrane 734 can adhere, so that the membrane and the crimp cap are not disturbed or detached from the container during handling.

As previously described, one of the difficulties of prior art vial closures is that they are not designed to permit a lyophilization operation and a stoppering operation to occur in a single step, thereby necessitating an additional stoppering operation, such as a crimping operation, which takes place outside of the sterile environment of the lyophilization chamber. Depending upon the construction of the lyophilization chamber and the structures provided by the lyophilization chamber, sterile closure assembly 20 of the present invention could be applied to container 10 within the sterile environment of the lyophilization chamber. For instance, structure may be provided within the lyophilization chamber to retain the sterile closure assemblies while the drug is being lyophilized in the containers, and which could thereafter be employed to seal the closure assemblies to the containers subsequent to lyophilization. Even with a crimping operation outside of the lyophilization chamber, the membrane feature of the sterile closure assembly obviates the need to sterilize the access area of the closure, such as with an alcohol solution, before access to the drug is desired.

However, it would be beneficial to incorporate the sterile closure features of the present invention in a lyophilization closure assembly which is self-retained to the container. Such a lyophilization closure assembly ideally could be finally sealed to the container, within the sterile environment of the lyophilization chamber and after the lyophilization process, without the need to incorporate costly modifications to the lyophilization equipment. The lyophilization closure assembly would thereby facilitate concurrent lyophilization and complete stoppering operations, the net result being reduced processing costs and particularly, the elimination of an additional processing operation, such as a crimping operation, outside of the sterile environment in which lyophilization takes place.

With the foregoing in mind, FIGS. 8–10 depict an embodiment 400 of a lyophilization closure assembly in accordance with the present invention. Lyophilization closure assembly 400 incorporates a sterile vial closure 420 with the features of the sterile closure assembly 20 previously described. Sterile vial closure 420 is incorporated within a body 460 that is constructed and arranged to permit lyophilization of a drug 16 contained within container 10 while the sterile vial closure is retained to the container. After lyophilization, while container 10 is located within the sterile environment of the freeze dryer, body 460 can be self-fastened to container 10 to permit sterile vial closure 420 to seal the open top of the container, eliminating the need for an additional processing operation, such as a crimping operation.

Body 460 includes a distal wall 462 disposed over open top 15 of the container. Distal wall 462 mates with a skirt 464 surrounding rim 17 of the container. Skirt 464 includes one or more deflective abutments 470 having an L-shaped grip 471 at a proximal end of the skirt. One or more deflectable latches 472 are formed intermediate L-shaped grips 471 and distal wall 462. As will be seen in FIG. 8, deflectable latches 472 are inwardly canted towards the interior of skirt 464. Body 460 may be initially attached about rim 17 by urging deflective abutments 470 around rim 17. The various dimensions are selected of the components are selected such that in a first position, rim 17 is retained between the one or more L-shaped grips 471 of the deflective abutments and the one or more deflectable latches 472. One or more vapor passages 474 are formed on skirt 464. When body 460 is disposed in its first position, vapor passages 474 communicate with open top 15 of the bottle, permitting vapor "V" generated during the lyophilization process to escape from the interior of container 10.

As before, sterile vial closure 420 includes an elastomeric closure 422 that is retained within body 460. As before, elastomeric closure 422 includes a plug 424 configured to fully block neck 18 so as to seal open top 15 of the container when lyophilization closure assembly 400 is positioned, respective of rim 17, in its second position (FIG. 9). As before, elastomeric closure 422 includes a top surface 426 intended to be accessed by an end user when it is desired to access medicament 16 contained within medicament container 10. Top surface 426 is accessible through body 400 via a central passage defined on distal wall 462. If desired, the elastomeric closure may also include a flange 428 disposed in surface contact with interior portions of distal wall 462 of the body. Flange 428 is designed to cover the upper surface of rim 17 when body 460 is disposed in its second position (FIG. 9). One or more sealing ribs 427 can be provided on flange 428 to enhance sealing contact between the flange and distal wall 462. Alternately, the sealing ribs can be provided on the interior portion of distal wall 462. Sealing ribs 427 can assume any suitable shape, such as the shapes illustrated in FIGS. 3–7.

As seen in FIG. 8, elastomeric closure 422 may include an upstanding projection 450. Top surface 426 of the elastomeric closure may thus be provided on upstanding projection 450. Body 460 may include a tubular extension 468 emanating from distal wall 462. Tubular extension 468 terminates in a bracket 467 defining a central passage 466. Upstanding projection 450 of elastomeric closure 422 can be retained within tubular extension 468 by providing a lip 456 which is lodged within a notch 469 defined within tubular extension 468. Lip 456 is captured within notch 469 and is sealingly retained against interior portions of bracket 467. One or more sealing ribs 452 can be provided on upstanding projection 450 of the elastomeric closure, for sealing contact with interior portions of tubular extension 468. Alternately, these sealing ribs can be provided on interior portions of tubular extension 468. In either instance, sealing ribs 452 can assume any suitable shapes, such as the shapes illustrated in FIGS. 3–7.

A membrane 434 can be affixed over lyophilization closure assembly 400 so as to protectively enclose top surface 426 of elastomeric closure 422 in a sterile manner. Membrane 434 includes a pull-tab 436. FIG. 8 illustrates that membrane 434 is affixed to flange 467 of the body, so as to protectively enclose top surface 426. Alternatively, if desired, FIG. 10 illustrates that a washer 530 can be provided against top surface 526 of elastomeric closure 522. Washer 530 includes an opening 532 which delimits an access area 526A on the top surface. Washer 530 is retained on the top surface of the elastomeric closure and can be dimensioned such that its outside edge rests adjacent central passage 566 defined by flange 567 of the body. Alternately, if desired, the washer can be dimensioned in a manner so as to be retained between the top surface of the elastomeric closure and flange 567, analogous to the constructions illustrated, for instance, in FIGS. 2–4. Membrane 534 can be secured in surface contact with washer 530 so as to protectively enclose access area 526A of elastomeric element 522. If desired, membrane 534 be extended and further secured in surface contact with flange 567 of body 560.

As before, elastomeric closure 422 can be formed of a suitable rubber material while body 460 can be formed from a suitable rigid material such as a plastic material. Membrane 434 can be formed from various plastic materials, composite materials, paper materials, metallic foil materials, TYVEK materials, or the like. The various components can be supplied to a pharmaceutical manufacturer in a sterile state, with the pharmaceutical manufacturer assembling them as part of its processing operation. Alternately, the various components can be pre-assembled by the component manufacturer and sterilized, so that a sterile, pre-assembled lyophilization closure assembly 400 is provided to the pharmaceutical manufacturer.

If desired, body 460 and elastomeric closure 422 can be formed together by a co-injection process, membrane 434 and body 460 can be formed together in a co-injection process, or all of body 460, elastomeric closure 422 and membrane 434 can be formed together in a co-injection process. If a washer 530 is employed (see FIG. 10), that may be formed together with any of the foregoing components, singly or in totality, in a co-injection process. Lyophilization closure assembly 400 in accordance with the present invention enables a pharmaceutical manufacturer to perform a lyophilization operation on a drug and a complete stoppering operation in the sterile environment of a freeze dryer, without the need for an additional stoppering operation, such as a crimping operation, outside of the sterile environment of the freeze dryer.

FIG. 8 illustrates lyophilization closure assembly 400 in its first position, wherein medicament 16 contained within the container can be subjected to a lyophilization procedure. The lyophilization closure assembly can be fitted over rim 17 into the position of FIG. 8 after drug 16 is introduced into container 10. As can be seen, in this position, plug 424 is not inserted into the neck of the container, but rather, it is positioned away from open top 15 of the container. The filled container can be introduced into an appropriate lyophilization chamber, such as a freeze-dryer, for lyophilization of drug 16. As lyophilization closure assembly 400 is self-supporting with the container, no additional structure is required in the lyophilization chamber to support the lyophilization closure assembly during the lyophilization process. Owing to the spacing of plug 424 respective of the open top of the container, any vapors "V" generated during the lyophilization procedure may freely exit container 10 via vapor passages 474 provided on body 460.

Subsequent to lyophilization of drug 16, container 10 must be stoppered in order to seal the drug. FIG. 9 illustrates lyophilization closure assembly 400 urged to a second position, wherein elastomeric closure 422 has been urged into sealing contact with open top 15 of the bottle, subsequent to the lyophilization procedure, while container 10 is retained within the sterile environment of the freeze dryer. A force "F" exerted, for instance, by shelves conventionally provided in the freeze dryer, is applied to body 460. Body 460 is urged proximally of rim 17, while deflectable latches 472 are pressed outwardly from their initial inward orientation so that they can pass about side 21 of rim 17. After deflectable latches 472 pass about side 21, they are free to re-assume their original inwardly-canted position, such that the deflectable latches are thrust into locking contact with lower surface 19 of the rim. Accordingly, body 460 is locked in the second position to firmly secure the lyophilization closure assembly to the container. Elastomeric closure 422 seals the open top of container 15, with vapor passages 474 blocked from communication with open top 15. Accordingly, the medicament is safely sealed within container 10 in a sterile manner.

It will be seen that various components can be dimensioned or otherwise configured such that when lyophilization closure assembly 400 is urged into the second position, plug 424 is urged into neck 18 to seal open top 15 of the bottle. Lower surface 429 of the flange is engaged in surface contact with top surface 13 of the rim, such that a seal is effected between these components. If desired, it will be realized that sealing ribs (not shown) may be provided between lower surface 429 of the flange and top surface 13 of the rim to enhance sealing contact between them. Moreover, it will be seen that vapor passages 474 are blocked from open top 15 of the medicament container, such that the medicament container is perfectly sealed by the lyophilization closure assembly while in the sterile environment in which lyophilization occurred. Membrane 434 hermetically protects top surface 426 of the elastomeric closure. When use of the drug is desired, an end user need only remove membrane 434 without the need to sterilize the access area, such as with an alcohol solution.

It will be appreciated and understood by those skilled in the art that further and additional forms of the invention may be devised without departing from the spirit and scope of the appended claims, the invention not being limited to the specific embodiments shown.

I claim:

1. A lyophilization closure assembly for a medicament container having an open top and a rim surrounding said open top, comprising:

a body secured about the open top of the container, the body having a distal wall disposed over the open top of the container and a skirt surrounding the rim of the container, a central passage provided on the distal wall, the skirt having a distal end, a proximal end, and one or more vapor passages formed therebetween, the body including one or more deflectable latches cooperable with the rim of the container and provided intermediate the distal and proximal ends of the skirt, the body having a first position, wherein the body is elevated from the open top of the container such that the vapor passages communicate with the open top, and a second position, wherein the deflectable latches lock the body to the rim and the vapor passages do not communicate with the open top of the container;

an elastomeric closure secured within said body for sealing the open top of the container when the body is in the second position, the elastomeric closure having a plug for sealing the open top of the container, and a top surface facing the central passage of the distal wall, the plug dimensioned to be spaced from the open top of the container when the body is in the first position such that the open top communicates with the vapor passages of the skirt; and a membrane removably secured across the central passage of the distal wall and hermetically enclosing the top surface of the closure.

2. The lyophilization closure assembly of claim 1, wherein the body includes a tubular extension surrounding the central passage of the distal wall and the elastomeric closure includes an upstanding projection securely retained within the tubular extension, the top surface of the closure provided on the upstanding projection.

3. The lyophilization closure assembly of claim 2, further comprising one or more sealing ribs disposed between the upstanding projection of the elastomeric closure and the tubular extension of the body.

4. The lyophilization closure assembly of claim 2, wherein the elastomeric closure includes a flange portion retained against the distal wall of the body, further comprising one or more sealing ribs disposed between the flange portion of the closure and the distal wall of the body.

5. The lyophilization closure assembly of claim 1, wherein the elastomeric closure includes a flange portion retained against the distal wall of the body.

6. The lyophilization closure assembly of claim 5, further comprising one or more sealing ribs disposed between the flange portion of the closure and the distal wall of the body.

7. A lyophilization closure assembly for a medicament container having an open top and a rim surrounding said open top, comprising:

a body secured about the open top of the container, the body having a distal wall disposed over the open top of the container and a skirt surrounding the rim of the container, a central passage provided on the distal wall, the skirt having a distal end, a proximal end, and one or more vapor passages formed therebetween, the body including one or more deflectable latches cooperable with the rim of the container and provided intermediate the distal and proximal ends of the skirt, the body having a first position, wherein the body is elevated from the open top of the container such that the vapor passages communicate with the open top, and a second position, wherein the deflectable latches lock the body to the rim and the vapor passages do not communicate with the open top of the container;

an elastomeric closure secured within said body for sealing the open top of the container when the body is in the second position, the elastomeric closure having a plug for sealing the open top of the container, a flange portion retained against the distal wall of the body, and a top surface facing the central passage of the distal wall, the plug dimensioned to be spaced from the open top of the container when the body is in the first position such that the open top communicates with the vapor passages of the skirt;

a washer secured in surface contact with the top surface of the closure, the washer defining an opening facing the central passage of the distal wall; and a membrane removably secured across the opening of the washer and hermetically enclosing the top surface of the closure.

8. The lyophilization closure assembly of claim 7, wherein the membrane is further removably secured across the central passage of the distal wall.

9. The lyophilization closure assembly of claim 7, further comprising one or more sealing ribs disposed between the flange portion of the elastomeric closure and the distal wall of the body.

10. The lyophilization closure assembly of claim 7, wherein the body includes a tubular extension surrounding the central passage of the distal wall and the elastomeric closure includes an upstanding projection securely retained within the tubular extension, the top surface of the closure provided on the upstanding projection.

11. The lyophilization closure assembly of claim 10 further comprising one or more sealing ribs disposed between the upstanding projection of the closure and the tubular extension of the body.

12. The lyophilization closure assembly of claim 7, wherein the elastomeric closure is formed of a rubber material and the washer is formed of a plastic material.

13. The lyophilization closure assembly of claim 12, wherein the elastomeric closure and the washer are formed together in a co-injection process.

14. The lyophilization closure assembly of claim 7, wherein the washer is formed of a plastic material and the membrane is formed of a foil material.

15. The lyophilization closure assembly of claim 14, wherein the washer and the membrane are formed together in a co-injection process.

16. The lyophilization closure assembly of claim 7, wherein the elastomeric closure is formed of a rubber material, the washer is formed of a plastic material, and the membrane is formed of a foil material.

17. The lyophilization closure assembly of claim 16, wherein the elastomeric closure, the washer, and the membrane are formed together in a co-injection process.

18. A lyophilization closure assembly for a medicament container having an open top and a rim surrounding said open top, comprising:

a body secured about the open top of the container, the body having a distal wall disposed over the open top of the container and a skirt surrounding the rim of the container, a central passage provided on the distal wall, the skirt having a distal end, a proximal end, and one or more vapor passages formed therebetween, the body having one or more deflectable latches cooperable with the rim of the container and provided intermediate the distal and proximal ends of the skirt, the body having a first position, wherein the body is elevated from the open top of the container such that the vapor passages communicate with the open top, and a second position, wherein the deflectable latches lock the body to the rim and the vapor passages do not communicate with the open top of the container;

an rubber closure secured within said body for sealing the open top of the container when the body is in the second position, the rubber closure having a plug for sealing the open top of the container, a flange portion retained against the distal wall of the body, and a top surface facing the central passage of the distal wall, the plug dimensioned to be spaced from the open top of the container when the body is in the first position such that the open top communicates with the vapor passages of the skirt;

a plastic washer secured in surface contact with the top surface of the closure, the washer defining an opening facing the central passage of the distal wall; and a foil membrane removably secured across the opening of the washer and hermetically enclosing the top surface of the closure.

19. The lyophilization closure assembly of claim 18, wherein the body includes a tubular extension surrounding the central passage of the distal wall and the rubber closure includes an upstanding projection securely retained within the tubular extension, the top surface of the rubber closure provided on the upstanding projection.

20. The lyophilization closure assembly of claim 19, further comprising one or more sealing ribs disposed between the flange portion of the closure and the distal wall of the body.

21. The lyophilization closure assembly of claim 18, wherein the foil is glued to the washer.

22. The lyophilization closure assembly of claim 21, further comprising one or more sealing ribs disposed between the upstanding projection of the rubber closure and the tubular extension of the body.

* * * * *